US009728353B2

(12) United States Patent
Knighton et al.

(10) Patent No.: US 9,728,353 B2
(45) Date of Patent: Aug. 8, 2017

(54) KEYSWITCH USING MAGNETIC FORCE

(71) Applicants: Mark S. Knighton, Santa Monica, CA (US); Mydul R. Islam, Van Nuys, CA (US); Tzyy-Woei R. Sung, Buena Park, CA (US); Kevin H. Vuong, Baldwin Park, CA (US)

(72) Inventors: Mark S. Knighton, Santa Monica, CA (US); Mydul R. Islam, Van Nuys, CA (US); Tzyy-Woei R. Sung, Buena Park, CA (US); Kevin H. Vuong, Baldwin Park, CA (US)

(73) Assignee: Synerdyne Corporation, Santa Monica, CA (US)

( * ) Notice: Subject to any disclaimer, the term of this patent is extended or adjusted under 35 U.S.C. 154(b) by 0 days.

(21) Appl. No.: 14/153,983

(22) Filed: Jan. 13, 2014

(65) Prior Publication Data

US 2014/0124346 A1 May 8, 2014

Related U.S. Application Data

(62) Division of application No. 13/546,854, filed on Jul. 11, 2012, now Pat. No. 8,629,362.

(51) Int. Cl.

| | |
|---|---|
| ***H01H 13/70*** | (2006.01) |
| ***H01H 13/52*** | (2006.01) |
| *H01H 3/12* | (2006.01) |

(52) U.S. Cl.

CPC ..... *H01H 13/52* (2013.01); *H01H 3/125* (2013.01); *H01H 2215/042* (2013.01); *H01H 2221/04* (2013.01)

(58) Field of Classification Search

CPC ..... H01H 2221/016; H01H 21/22; H01H 13/705; H01H 21/24; H01H 2003/466; H01H 36/004; H01H 36/00; H01H 5/02; H01H 36/0073; H01H 36/0066; H01H 36/02; H01H 13/70; H01H 2221/04; H01H 36/002; H01H 36/0033

See application file for complete search history.

(56) References Cited

U.S. PATENT DOCUMENTS

| | | | |
|---|---|---|---|
| 1,652,464 | A | 12/1927 | Tyberg |
| 2,532,228 | A | 11/1950 | Hesh |
| 3,399,287 | A | 8/1968 | Euler |
| 3,633,724 | A | 1/1972 | Samuel |

(Continued)

FOREIGN PATENT DOCUMENTS

| | | |
|---|---|---|
| CN | 202553446 | 11/2012 |
| WO | WO-94/06073 A1 | 3/1994 |

OTHER PUBLICATIONS

Written Opinion of the International Search Authority & International Search Report in PCT/US2014/01320 dated Oct. 30, 2014. 6 pages.

(Continued)

*Primary Examiner* — Xuong Chung Trans
(74) *Attorney, Agent, or Firm* — Thomas Coester Intellectual Property

(57) ABSTRACT

A key for user input having superior tactile qualities. The key is suspended by a magnetic field force to improve the smoothness of motion. Two compact interleaved members link a keycap to a key base to provide highly precise parallel travel with reduced tilt and flexion, and improved durability.

3 Claims, 9 Drawing Sheets

(56) References Cited

U.S. PATENT DOCUMENTS

| | | | | |
|---|---|---|---|---|
| 4,201,489 | A | 5/1980 | Zapp | |
| 4,256,931 | A | 3/1981 | Palisek | |
| 4,440,515 | A | 4/1984 | Nassimbene | |
| 4,449,839 | A | 5/1984 | Bleuer | |
| 4,536,625 | A | 8/1985 | Bebie | |
| 4,584,443 | A | 4/1986 | Yaeger | |
| 4,654,647 | A | 3/1987 | Wedam | |
| 4,719,455 | A | 1/1988 | Louis | |
| 4,761,522 | A | 8/1988 | Allen | |
| 4,778,295 | A | 10/1988 | Bleuer | |
| 4,896,003 | A | 1/1990 | Hsieh | |
| 4,913,573 | A | 4/1990 | Retter | |
| 4,935,728 | A | 6/1990 | Kley | |
| 4,964,075 | A | 10/1990 | Shaver et al. | |
| 5,012,230 | A | 4/1991 | Yasuda | |
| 5,017,030 | A | 5/1991 | Crews | |
| 5,086,296 | A | 2/1992 | Clark | |
| 5,087,910 | A | 2/1992 | Guyot-Sionnest | |
| 5,252,952 | A | 10/1993 | Frank et al. | |
| 5,383,735 | A | 1/1995 | Smiley | |
| 5,424,516 | A | 6/1995 | Emmons | |
| 5,424,728 | A | 6/1995 | Goldstein | |
| 5,497,151 | A | 3/1996 | Dombroski | |
| 5,504,502 | A | 4/1996 | Arita et al. | |
| 5,528,235 | A | 6/1996 | Lin et al. | |
| 5,564,560 | A | 10/1996 | Minelli | |
| 5,644,338 | A | 7/1997 | Bowen | |
| 5,661,505 | A | 8/1997 | Livits | |
| 5,666,138 | A | 9/1997 | Culver | |
| 5,772,008 | A | 6/1998 | Yu et al. | |
| 5,790,108 | A | 8/1998 | Salcudean et al. | |
| 5,808,603 | A | 9/1998 | Chen | |
| 5,818,361 | A | 10/1998 | Acevedo | |
| 5,841,374 | A | 11/1998 | Abraham | |
| 5,841,635 | A | 11/1998 | Sadler et al. | |
| 6,031,469 | A | 2/2000 | Dodd | |
| 6,046,754 | A | 4/2000 | Stanek | |
| 6,075,522 | A | 6/2000 | Milroy | |
| 6,103,979 | A | 8/2000 | Motoyama et al. | |
| 6,157,323 | A | 12/2000 | Tso et al. | |
| 6,168,331 | B1 | 1/2001 | Vann | |
| 6,204,839 | B1 | 3/2001 | Mato | |
| 6,230,222 | B1 | 5/2001 | Rush | |
| 6,307,537 | B1 | 10/2001 | Oowada | |
| 6,307,538 | B1 | 10/2001 | Bacon | |
| 6,348,878 | B1 | 2/2002 | Tsubai | |
| 6,386,773 | B1 | 5/2002 | Mathias | |
| 6,417,838 | B1 | 7/2002 | Inamura | |
| 6,437,682 | B1 | 8/2002 | Vance | |
| 6,510,048 | B2 | 1/2003 | Rubenson et al. | |
| 6,520,699 | B2 | 2/2003 | Abe | |
| D473,226 | S | 4/2003 | Griffin | |
| 6,542,091 | B1 | 4/2003 | Rasanen | |
| 6,542,149 | B1 | 4/2003 | Chung | |
| 6,594,142 | B2 | 7/2003 | Katz | |
| 6,670,873 | B2 * | 12/2003 | Inada et al. | 335/205 |
| 6,677,843 | B1 | 1/2004 | Monroe et al. | |
| 6,679,639 | B2 | 1/2004 | Katz | |
| 6,761,494 | B2 | 7/2004 | Hsu et al. | |
| 6,798,649 | B1 | 9/2004 | Olodort et al. | |
| 6,839,781 | B1 | 1/2005 | Kanazawa | |
| 6,869,239 | B2 | 3/2005 | Morris | |
| 6,928,461 | B2 | 8/2005 | Tuli | |
| 6,971,147 | B2 | 12/2005 | Halstead | |
| 7,075,520 | B2 | 7/2006 | Williams | |
| 7,202,853 | B2 | 4/2007 | Ng et al. | |
| 7,218,248 | B2 | 5/2007 | Kong et al. | |
| 7,307,620 | B2 | 12/2007 | Siddeeq | |
| 7,310,053 | B2 | 12/2007 | Bollman | |
| 7,401,300 | B2 | 7/2008 | Nurmi | |
| 7,595,742 | B2 | 9/2009 | Cozzi et al. | |
| 7,642,886 | B2 | 1/2010 | Boss | |
| 7,736,078 | B2 | 6/2010 | Webber | |
| 7,775,801 | B2 | 8/2010 | Shiff et al. | |
| 7,900,844 | B2 | 3/2011 | Alden | |
| 8,079,766 | B2 | 12/2011 | Kinney | |
| 8,081,092 | B2 | 12/2011 | Laufkotter | |
| 8,102,647 | B2 | 1/2012 | Bhutani et al. | |
| 8,414,207 | B1 * | 4/2013 | Knighton et al. | 400/485 |
| 2001/0006587 | A1 | 7/2001 | Keinonen et al. | |
| 2002/0027549 | A1 | 3/2002 | Hirshberg | |
| 2002/0037715 | A1 | 3/2002 | Mauney et al. | |
| 2002/0085337 | A1 | 7/2002 | Rubenson et al. | |
| 2002/0138582 | A1 | 9/2002 | Chandra et al. | |
| 2002/0149566 | A1 | 10/2002 | Sarkissian | |
| 2003/0030542 | A1 | 2/2003 | von Hoffmann | |
| 2003/0099086 | A1 | 5/2003 | Chuang | |
| 2003/0132916 | A1 | 7/2003 | Kramer | |
| 2003/0193478 | A1 | 10/2003 | Ng et al. | |
| 2003/0197685 | A1 | 10/2003 | Yi | |
| 2004/0061683 | A1 | 4/2004 | Mochizuki et al. | |
| 2004/0183785 | A1 | 9/2004 | Liu et al. | |
| 2004/0190968 | A1 | 9/2004 | Yang | |
| 2004/0239533 | A1 | 12/2004 | Bollman | |
| 2005/0002158 | A1 | 1/2005 | Olodort et al. | |
| 2005/0123333 | A1 | 6/2005 | Sugimura et al. | |
| 2005/0140653 | A1 | 6/2005 | Pletikosa et al. | |
| 2006/0088356 | A1 | 4/2006 | Jawerth et al. | |
| 2006/0159507 | A1 | 7/2006 | Jawerth et al. | |
| 2006/0255971 | A1 | 11/2006 | Kim et al. | |
| 2006/0274045 | A1 | 12/2006 | Stenbroten | |
| 2007/0008291 | A1 | 1/2007 | Liu | |
| 2007/0150953 | A1 | 6/2007 | Hamid et al. | |
| 2007/0165002 | A1 | 7/2007 | Wassingbo | |
| 2007/0172287 | A1 | 7/2007 | Hirsch | |
| 2007/0268261 | A1 | 11/2007 | Lipson | |
| 2007/0279388 | A1 | 12/2007 | Pletikosa et al. | |
| 2007/0290890 | A1 | 12/2007 | Chen et al. | |
| 2009/0033628 | A1 | 2/2009 | Srivastava | |
| 2009/0222908 | A1 | 9/2009 | Warren | |
| 2009/0257807 | A1 | 10/2009 | Woloschyn | |
| 2009/0262492 | A1 | 10/2009 | Whitchurch et al. | |
| 2009/0309616 | A1 | 12/2009 | Klinghult et al. | |
| 2010/0040400 | A1 | 2/2010 | Hirsch | |
| 2010/0055928 | A1 | 3/2010 | Randall | |
| 2010/0065454 | A1 | 3/2010 | Badillo et al. | |
| 2010/0073302 | A1 | 3/2010 | Ritzau et al. | |
| 2010/0073855 | A1 | 3/2010 | Liang et al. | |
| 2010/0184378 | A1 | 7/2010 | Wakefield | |
| 2010/0222110 | A1 | 9/2010 | Kim et al. | |
| 2010/0253629 | A1 | 10/2010 | Orsley | |
| 2010/0254111 | A1 | 10/2010 | Ligtenberg et al. | |
| 2010/0259482 | A1 | 10/2010 | Ball | |
| 2011/0028006 | A1 | 2/2011 | Shah et al. | |
| 2011/0031287 | A1 | 2/2011 | Le Gette et al. | |
| 2011/0063787 | A1 | 3/2011 | Griffin | |
| 2011/0170250 | A1 | 7/2011 | Bhutani et al. | |
| 2011/0223352 | A1 | 9/2011 | Chen | |
| 2011/0267278 | A1 | 11/2011 | Wickstrom | |
| 2011/0304555 | A1 | 12/2011 | Murphy | |
| 2012/0293417 | A1 | 11/2012 | Dennis | |

OTHER PUBLICATIONS

Non-Final Office Action in U.S. Appl. No. 14/223,167 dated Jun. 22, 2015. 23 pages.

International Preliminary Report on Patentability in PCT/US2014/018407 mailed Sep. 1, 2015. 6 pages.

Extended Search Report in European Patent Application No. 13743244.9. 9 pages.

Notice of Allowance in U.S. Appl. No. 13/778,016 mailed Sep. 23, 2015. 26 pages.

* cited by examiner

KEYSWITCH USING MAGNETIC FORCE

CROSS-REFERENCE TO RELATED APPLICATION

This application is a divisional of pending U.S. patent application Ser. No. 13/546,854, filed Jul. 11, 2012, entitled, "KEYSWITCH USING MAGNETIC FORCE".

BACKGROUND

Field of the Invention

Embodiments of the inventions relate to user input buttons and keyboards comprised thereof. More particularly, embodiments of the invention relate to magnetically biased keys, including those with a high degree of parallel motion.

Background

Keyboards of various types are ubiquitous in today's technological arena. Important factors in a keyboard's usability are its size and feel to a user. High end computer keyboards employ a vertical bearing shaft to ensure parallelism as the key is depressed. However, such structures are impractical for low profile keyboards common on laptop computers or for use with other mobile devices. The current commercial state of the art in low profile keyboards uses a plastic scissor mechanism to control the motion of a key during actuation, and a rubber dome to provide a spring force. For small keys, the scissor mechanism generally provides sufficient parallelism, so that there is relatively little tilt from side to side as the key is actuated, which does not significantly impact usability. However, with larger keys such as the shift, return, and space bar keys, the plastic scissor mechanisms tend to flex, resulting in uneven actuation or jamming. To combat this, contemporary designs add metal support bars which improve the parallelism. These bars transfer actuation force from where the key is pressed to the remote end of the key. This acts to pull down the remote end and limit the tilt of the key during actuation, thereby improving parallelism. Unfortunately, these metal bars, (which generally run along two sides of the key), also increase part count, mechanical slop, weight, and noise, all of which reduce the precision of motion and the quality of feel for the user. Depending upon the size, stiffness, and precision of these bars, a key may still exhibit residual tilt when actuated off-center. Moreover, the loss of parallelism is exacerbated as the key increases in size.

Even for the smaller keys, the "fingertip feel" or tactile sensation of actuating the keys deteriorates as the finger senses the imperfections in the mechanism. Further, the current practice of scissor plus rubber dome architectures produces a mushy feel at the end of their travel. This is due to a small cylindrical rubber nib at the center. of the rubber dome. The nib is designed to apply pressure to a membrane switch below the dome. As the nib compresses, it creates a spongy, less crisp feel. Development of a key which eliminates these deficits and provides an improved feel for low profile keyboards is desirable.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
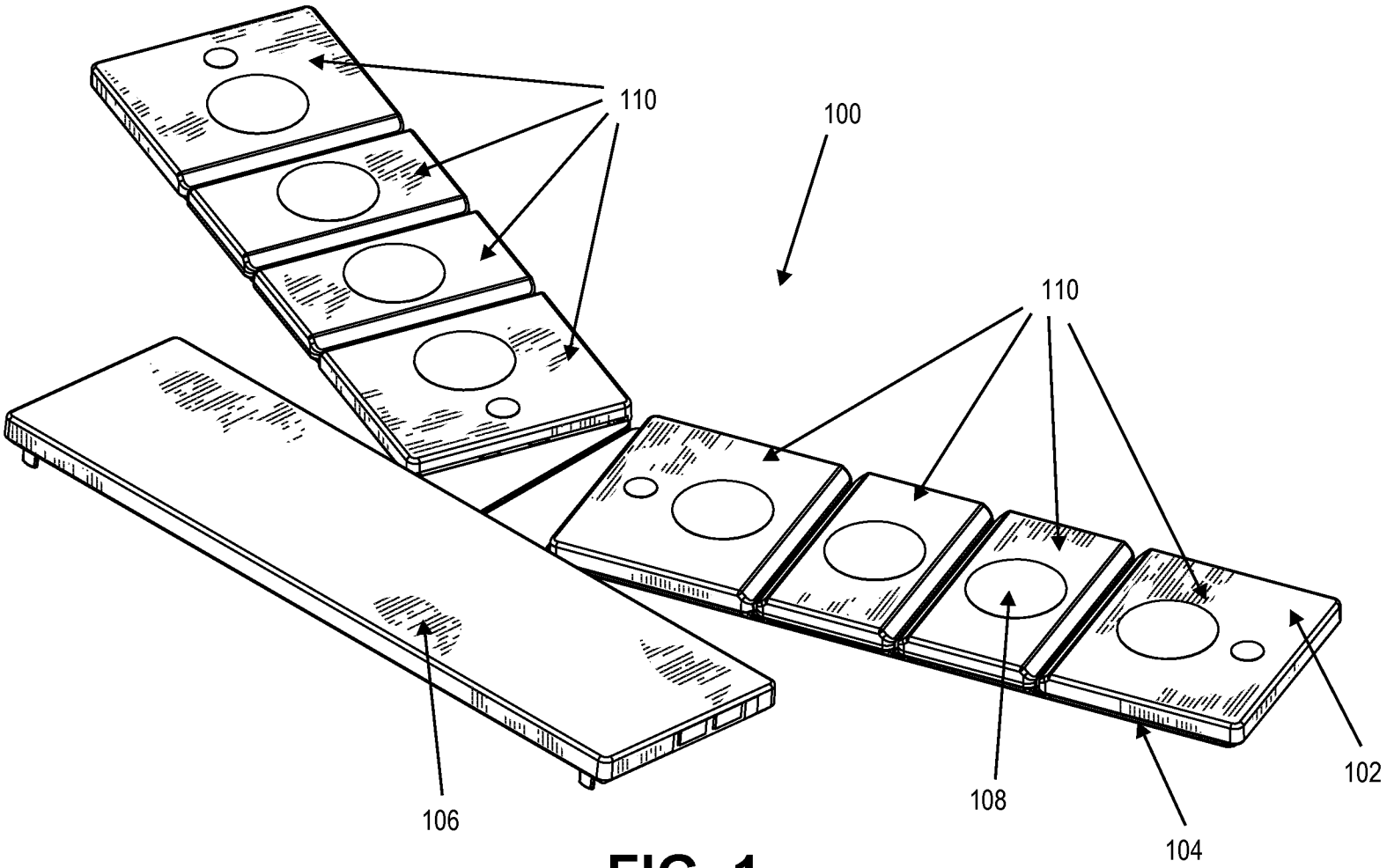
FIG. 1 is a perspective view of keyboard employing keys of one embodiment of the invention.

FIG. 1 is a perspective view of keyboard employing keys of one embodiment of the invention. Keyboard 100 includes 8 keys 110 and a space bar 106 each of which may represent some embodiment of the invention as described further below. Each key 110 includes a key cap 102 and a key base 104. Key cap 102 may provide a tactile indication such as depression 108 to allow a user to locate their fingers on the key. In one embodiment, key caps 102 and key bases 104 are injection molded from thermoplastic such as polycarbonate. Key bases are also commonly made of stamped metal. While this embodiment has eight keys, the key construction described below can be used on a keyboard with any number and any size of keys. By way of example, the techniques and structures could be used in a standard QWERTY style keyboard for a laptop or desktop computer.

Figure 2:
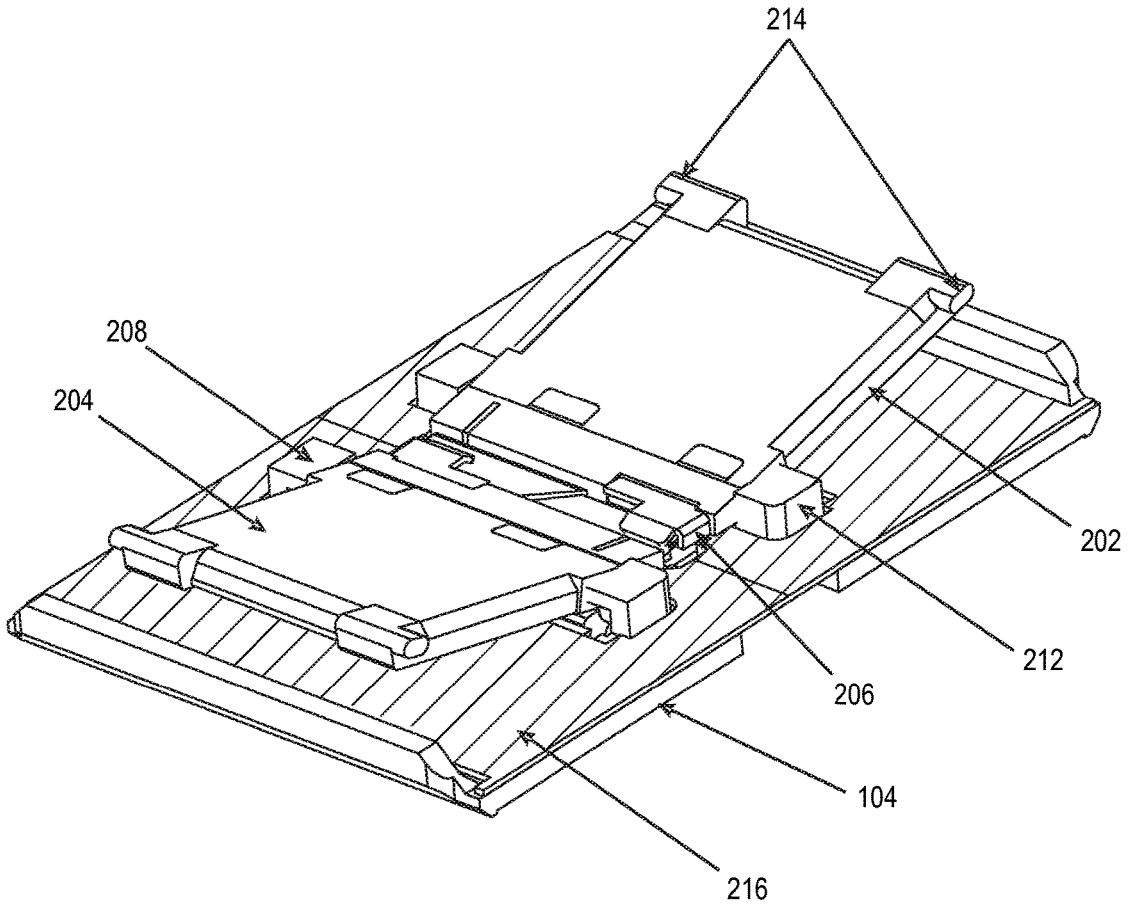
FIG. 2 is a diagram of a key according to one embodiment of the invention with the key cap removed.

FIG. 2 is a diagram of a key according to one embodiment of the invention with the key cap removed. Key base 104 may be molded from a thermoplastic. The capacitive sensing pad 216 may overlay key base 104. In one embodiment, the capacitive sensing pad 216 detects a keypress when a user's finger becomes more proximate to the sensing pad. A detectable change in capacitance occurs allowing determination of the keypress event. Further, the location of the finger during the keypress event may be determined by measuring the relative change in capacitance at sensing pad 216 as compared with a counterpart on the other side of the key. Key base 104 may also define a plurality of axle housings 212 to rotationally engage axles (not shown) of link members 202 and 204. Link members 202 and 204 engage each other in an interleaved fashion through coupling members 206 and 208. In one embodiment, coupling members 206 and 208 are magnetic masses such as steel that can be attracted to an underlying magnet (not shown) disposed in key base 104. In one embodiment, additional capacitive sensors are provided within the key to detect delamination of the magnetic masses from the underlying magnet to signal a keypress event. In one embodiment capacitive sensing pad 216 is formed as part of a flex circuit that may also include the additional capacitive sensors (discussed below with reference to FIG. 4).

Link members may be formed of a combination of steel and plastic using an insert molding process. Generally a high rigidity plastic is selected. One suitable plastic is acetyl resin available under the trademark DELRIN from Dupont Corporation. In some embodiments one link member may be somewhat longer than the other. However, it is preferred to keep the link member relatively short such that neither link member exceeds a length of 70 percent of the maximum cross dimension of the key cap. Minimizing the length of link members 202 and 204 increases their stiffness which improves the parallelism during key depression. In one embodiment, neither link 202 nor link 204 exceeds 50 percent of the maximum cross dimension of the key cap. In one embodiment, both link member 202 and 204 are identical such that they can be manufactured in a single mold and simply flipped relative to one another for purposes of assembly. Each link member 202 and 204 defines a pair of pegs 214 to engage slots (not shown) in the key cap.

Figure 3A:
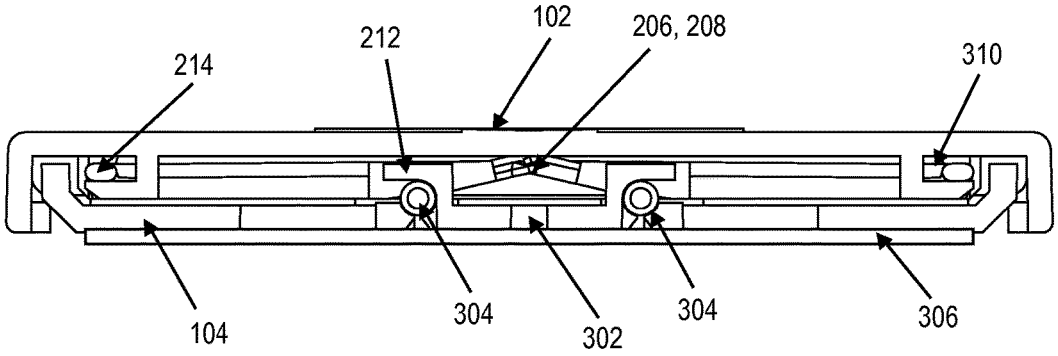
FIG. 3A is a cross-sectional diagram of a key of one embodiment of the invention in a depressed (actuated) configuration.

FIG. 3A is a cross-sectional diagram of a key of one embodiment of the invention in a keypress down configuration. When sufficient pressure is applied to key cap 102, the magnetic masses, in this case coupling numbers 206 and 208, delaminate from magnet 302 resident in key base 104. In one embodiment, coupling members 206,208 are formed of a ferromagnetic metal such as SUS430 stainless steel. Steel has high rigidity and durability and is well suited for this application. Other embodiments may have the coupling members made partially or entirely from a non-magnetic material, but use a magnetic mass disposed therein.

A magnet 302 may be a rare earth magnet which generates a suitable magnetic field which continues to exert an attractive force even after delamination of magnetic masses 206, 208 from the magnet 302. This field provides a force even when there is no contact between the magnet and magnetic mass, which force can raise the key back up after the user releases their finger press. The tactile feel for a user is controlled by the force vs. displacement curve, which may be adjusted by changes to the size and geometry of the magnet, magnetic masses, and relative axle location. In one embodiment, a suitable magnet provides a magnetic field sufficient to produce about 50 grams of button force in the completed assembly. In one embodiment, an N52 magnet made of NdFeB material, having dimensions of about 10 by 1 by 1.4 millimeters is sufficient to provide at least 50 grams of force.

In this sectional view, link axles 304 can be seen residing in axle housing 212. Axles are translationally fixed within axle housing 212 however; they are able to rotate to permit depression/actuation of the key cap 102. To accommodate the movement of the opposing end of the link, peg members 214 reside in slots 310 in the keycap 102 which permit the pegs to translate away from the center of the key sufficient distance to permit the key to be fully depressed. In one embodiment, a gripping pad 306 may be applied to the under surface of key base 104 to minimize movement of the keyboard on a supporting surface. For example, in one embodiment, gripping pad 306 may be an elastomeric material with favorable frictional characteristics on common surfaces such as wood, metal, and plastic. In one embodiment, the pad is made from silicone rubber.

Figure 3B:
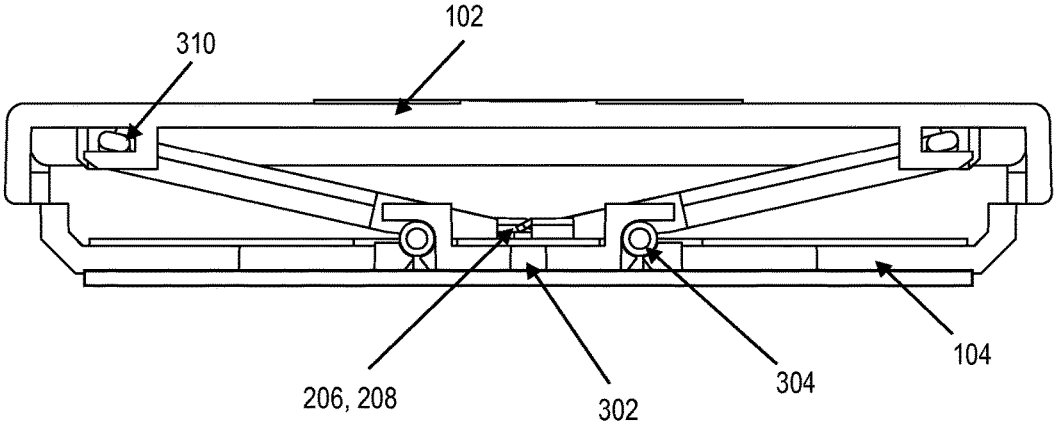
FIG. 3B is a sectional diagram of the key of FIG. 3A in a steady state (not actuated) orientation.

FIG. 3B is a sectional diagram of the key of FIG. 3A in a steady state orientation. By referring to this orientation as a steady state orientation, Applicant intends to indicate that this is the state the key will adopt absent the application of an external force. This may also be thought of as the "up" state for the key. In this configuration, magnet 302 is sufficiently close to magnetic masses 206, 208 to be functionally laminated thereto. The back end of slots 310 in key cap 102 in conjunction with the magnetic lamination of the magnet to the magnetic masses both provide hard stops that prevent the key from rising above the prescribed level in the steady state. Stops (not visible in this figure) are molded into key cap 102 such that the lateral translation of each of the links and pegs is limited by those hard stops. The hard stops also minimize the risk that the key cap will become detached from the links during normal use.

Figure 4A:
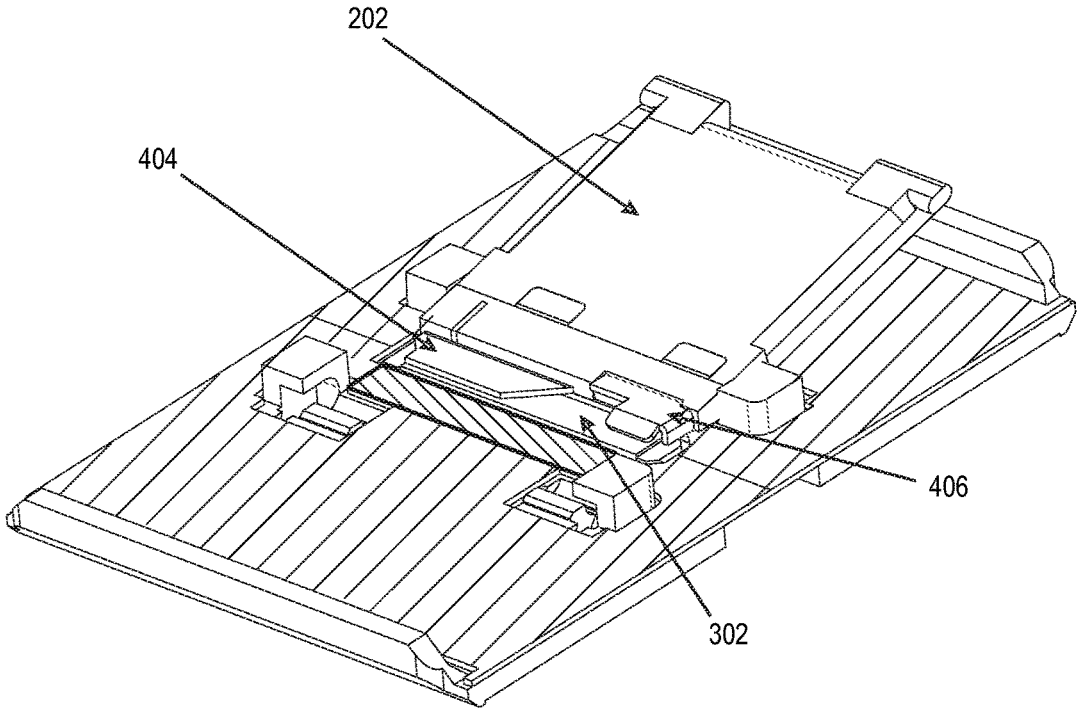
FIG. 4A is a cutaway view showing a single link of one embodiment in the invention.

FIG. 4A is a cutaway view with the keycap removed showing a single link of one embodiment in the invention. Coupling member 202 comprises upper interleaved member 406 and lower interleaved member 404. Magnet 302 is shown beneath the coupling members. Link 204 (not shown in this Figure) would have mirror images of lower interleaved member 404 and upper interleaved member 406 such that the lower interleaved member for link 204 would overlay magnet 302 adjacent to lower interleaved member 404 and beneath upper interleaved member 406. Similarly, the upper interleaved member for link 204, when installed is disposed above and in engagement with lower interleaved member 404.

Figure 4B:
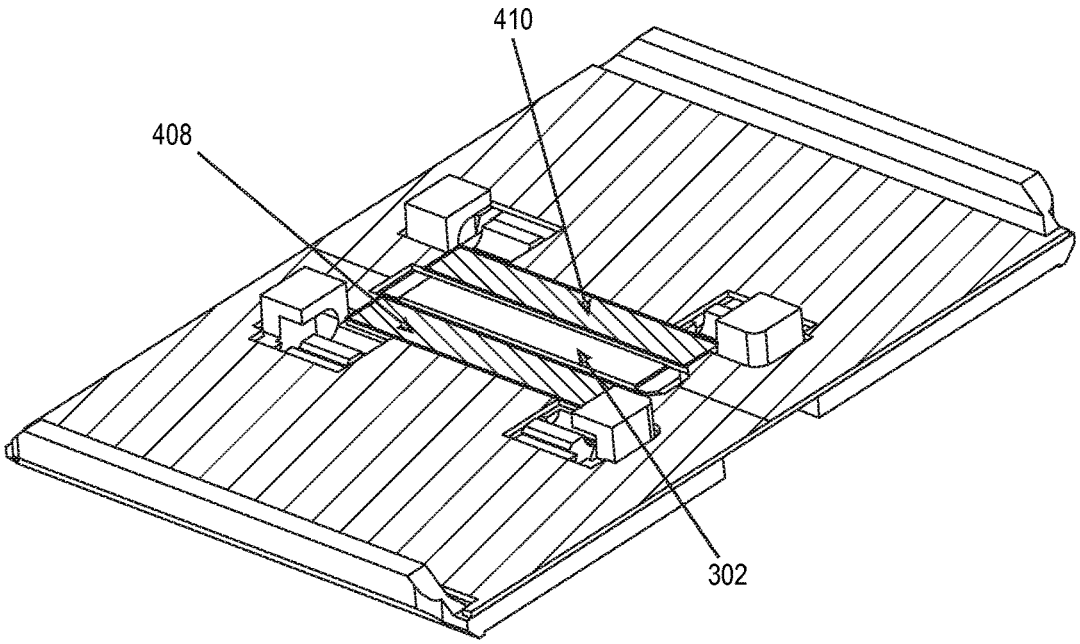
FIG. 4B is a cutaway view of the keybase with both link members removed to expose the sensors.

FIG. 4B is a cutaway view of the keybase with both link members removed to expose the sensors. Sensor 216 (identified previously in FIG. 2) is a capacitive sensing pad formed of a copper pad area of the flex circuit adhered to the keybase 104. Additional capacitive sensors 408 and 410 are formed of additional copper pad areas on the same flex circuit. Sensors 408 and 410 each capacitively coupled to link members 202 and 204 respectively. When the link members are in contact with the magnet 302, the metal surfaces of the magnetic masses 206 and 208 are in proximity to the additional sensors 408 and 410, which causes an increased capacitive coupling. When the magnetic masses 206 and 208 delaminate from magnet 302 during a keypress event, the capacitive coupling is reduced. By monitoring this capacitive coupling, the up or down state of the key can be determined.

Figure 5:
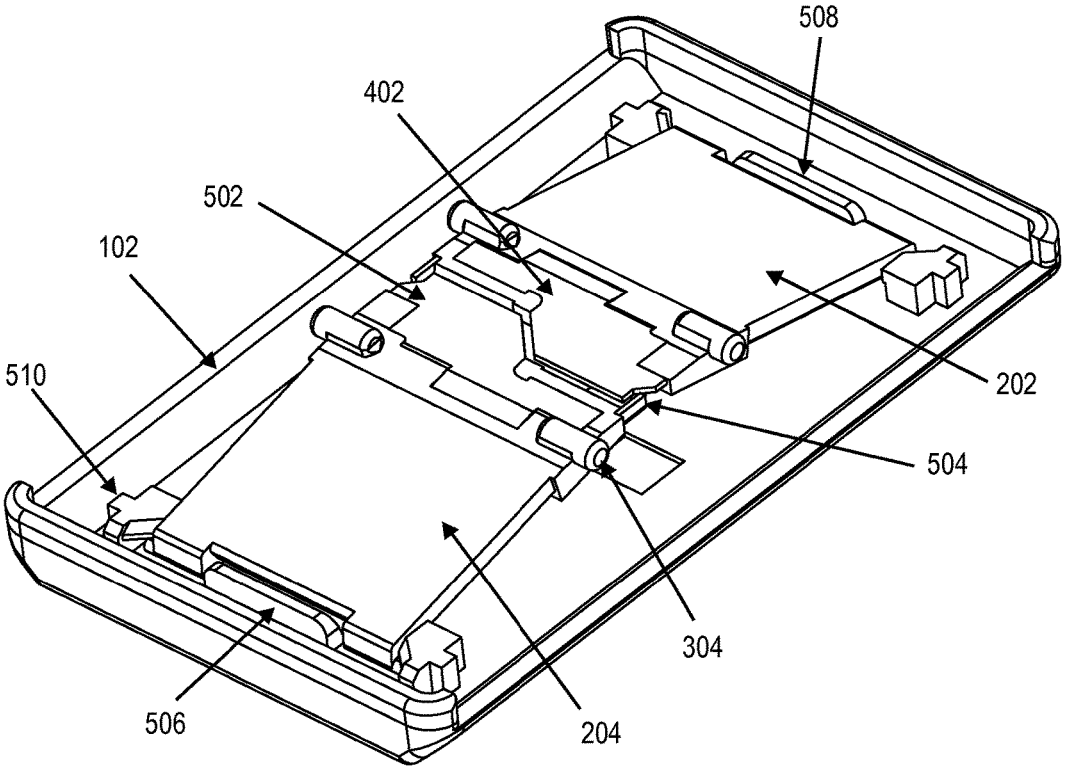
FIG. 5 is a bottom view of a key of one embodiment of the invention with the key base removed.

FIG. 5 is a bottom view of a key of one embodiment of the invention with the key base removed. In this view can be seen links 202 and 204 and their respective lower interleaved members 402 and 502. Upper interleaved member 504 of link 204 resides in engagement with lower interleaved member 402. Link axles 304 are also visible. The hard stops 506 and 508 may be molded as part of key cap 102. The link-facing surface of hard stops 506 and 508 is sloped to guide engagement as it approaches the bottom of travel during keypress. Slot housings 510 may also be molded as part of key cap 102. As discussed above, slot housings 510 define the slots in which pegs (element 214 from FIG. 3A) translate during key actuation.

Figure 6:
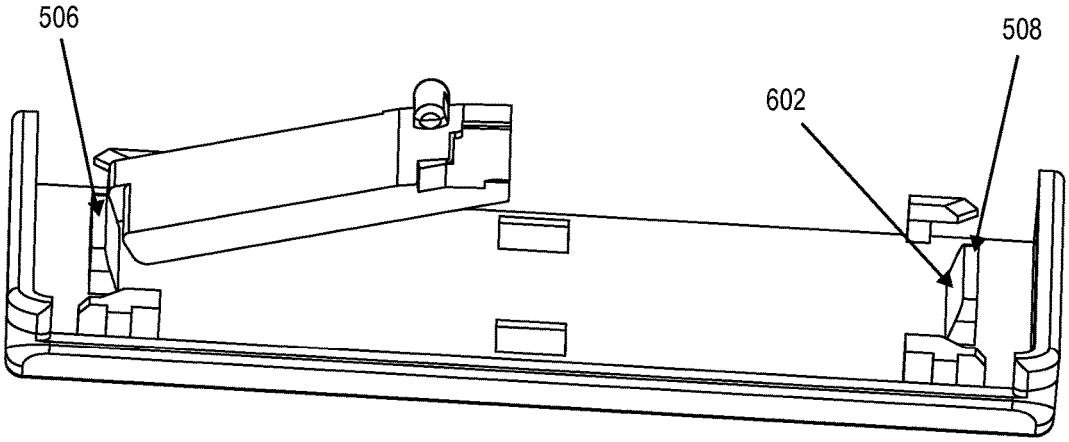
FIG. 6 is a sectional view of FIG. 5.

FIG. 6 is a sectional view of FIG. 5. In this view, the sloped surface 602 of hard stop 508 is clearly visible. In this "Up" state for the key, surface 602 limits the amount of distortion of the assembly if a lateral load is applied to the keycap and slots. In the "Down" of the key, surface 602 resists lateral motion of pegs 214 within slots 310 to prevent unintended detachment of the key cap 102 from the key base 104.

Figure 7:
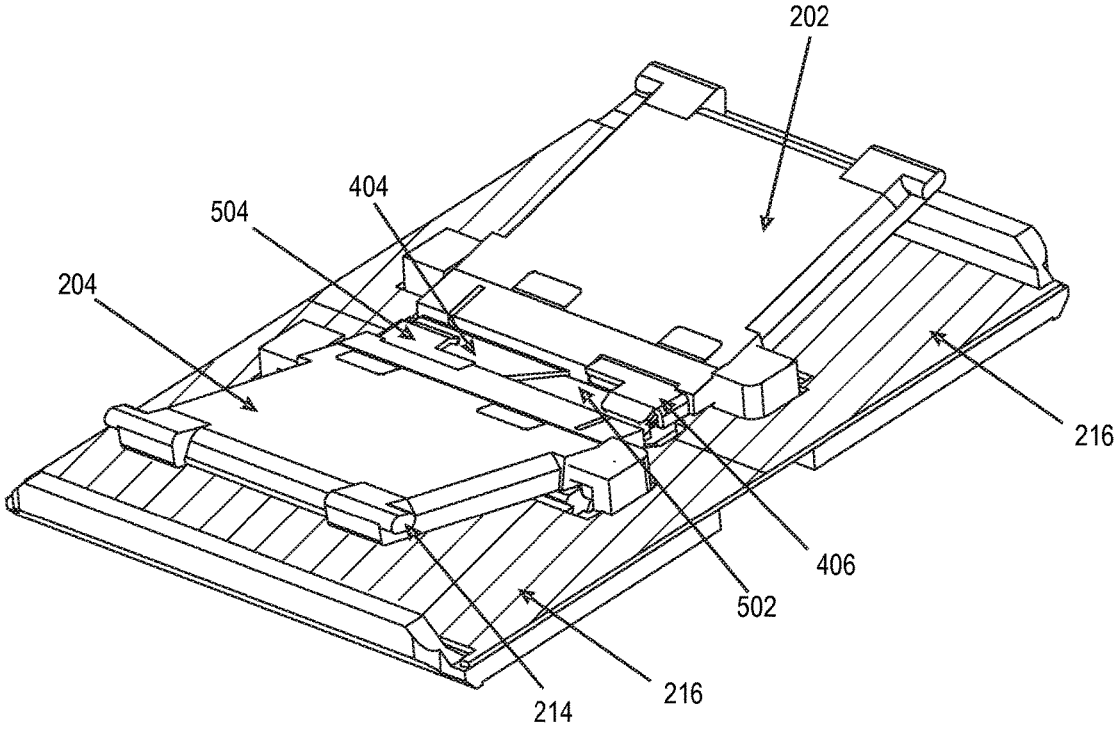
FIG. 7 is a diagram of a key of one embodiment of the invention with the key cap removed.

FIG. 7 is a diagram of a key of one embodiment of the invention with the key cap removed showing an additional perspective view in the steady state up orientation. Link members are maintained in the steady state position by the magnetic field of the magnet underlying the interleaved coupling members 404, 406, 504 and 502 which mutually engage in an interleaved fashion as previously described. Capacitive sensing pad 216 occupies substantially one half of surface area of the entire base of the key outside the magnetic region. Pegs 214 are integrally molded as part of respective link members and engage slots in the key cap when the key cap is installed. The described structure permits highly parallel key with minimal tilt regardless of where on the keycap the keypress force is applied. The firm capacitive pad and magnet eliminate the mushy tactile sensation at the bottom of travel commonly associated with the cylindrical actuator nib of rubber dome key mechanisms. The capacitive pad 216 and its counterpart on the other half of the key base allows determination of a keypress, and may also be used to determine where on a key surface the key was pressed by a fingertip. This effectively allows for one key to provide multiple functions. However, as previously noted this structure may be applied to yield a superior tactile sensation even where small single-function keys are required.

The replacement of the standard keyswitch scissor elements with the link members improves parallelism during actuation and eliminates the need for metal reinforcement bars on larger keys. The disclosed structure permits construction of a key with a reduced part count and better feel. Additionally, the simpler nesting of the links allows larger size features such as axle, pegs etc., which are more robust than typical existing key structures resulting in greater durability. Notably, the magnet does not suffer from the kind of material stress or fatigue which limits the useful life of click domes and other prior art devices. In one embodiment the key cap and key base are both injection-molded. The magnet may have flanges which trap it in place in a recess in the key base, and further captured by an adhesive-backed polymer sheet affixed to the back of the key base. Adhesives may also be used to secure the magnet. The capacitive flexible circuit pad is adhered to the key base with a pressure-sensitive adhesive tape backing. The link members are interleaved and snapped into the axle housings and the pegs are snapped into the slots defined in the key cap.

In an alternative embodiment, a base for a plurality of keys is injection-molded as a single unit that defines recesses for a plurality of magnets, at least one of which is associated with each key, and defines corresponding numbers of axle housings for each of the keys. The capacitive sensors may be instantiated as individual sensor components or as a single integrated flexible circuit panel with sensing pads for each key in the array of keys residing on a multi-key substrate. Each sensor can be electrically distinct to detect areas of a particular key. Further, a key can have one sensor pad, or a plurality of sensor pads in discrete spatial zones to facilitate measurement of the location of a fingertip on the keycap.

Figure 8A:
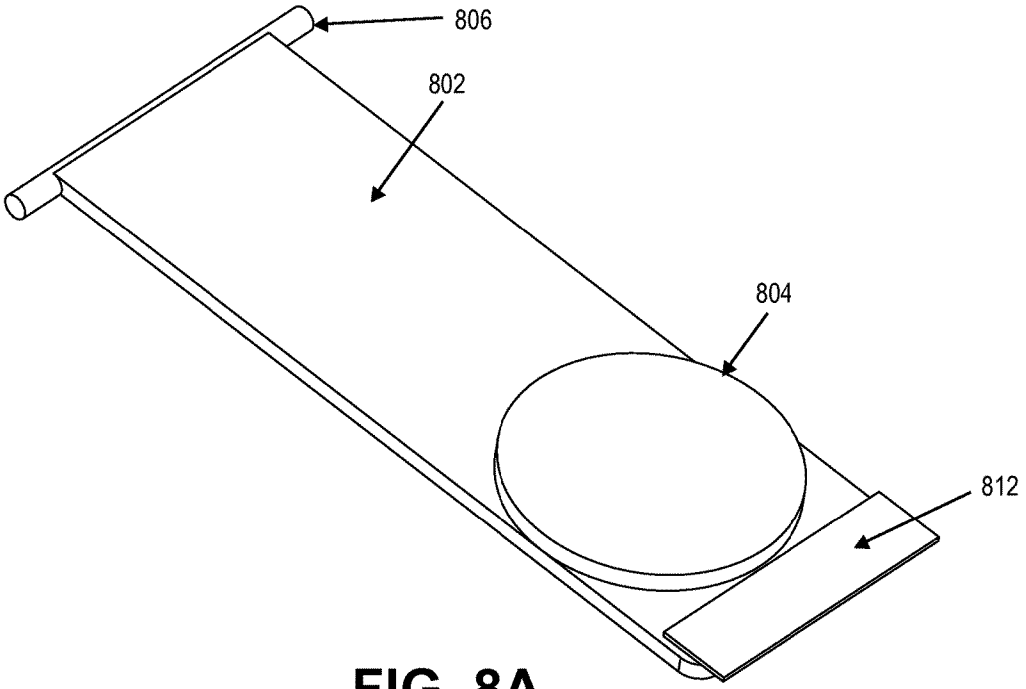
FIGS. 8A and B are schematic views of the button of an alternative embodiment of the invention.
Figure 8B:
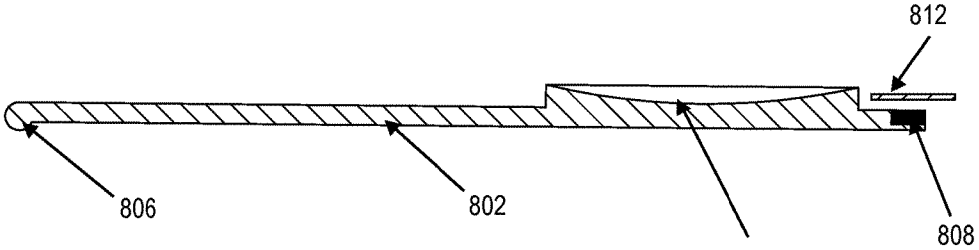
Figure 9C:
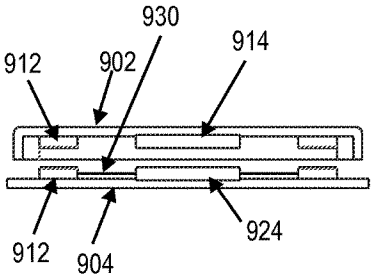
FIGS. 9A-D are schematic views of a key of an alternative embodiment of the invention.
Figure 9D:
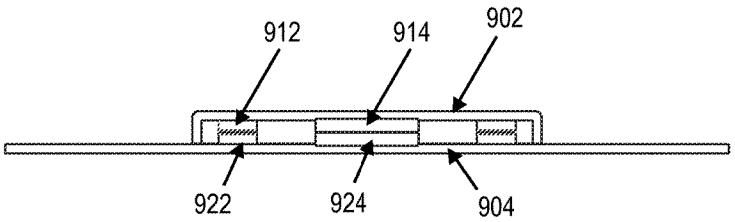
Figure 9A:
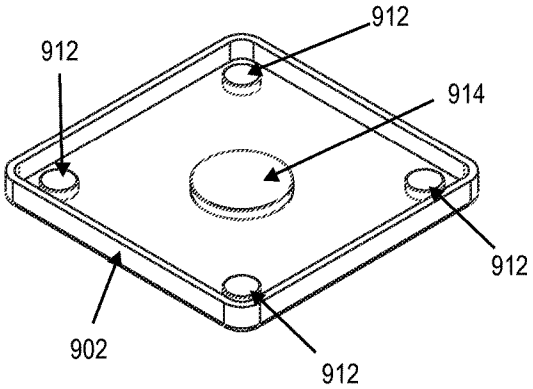
Figure 9B:
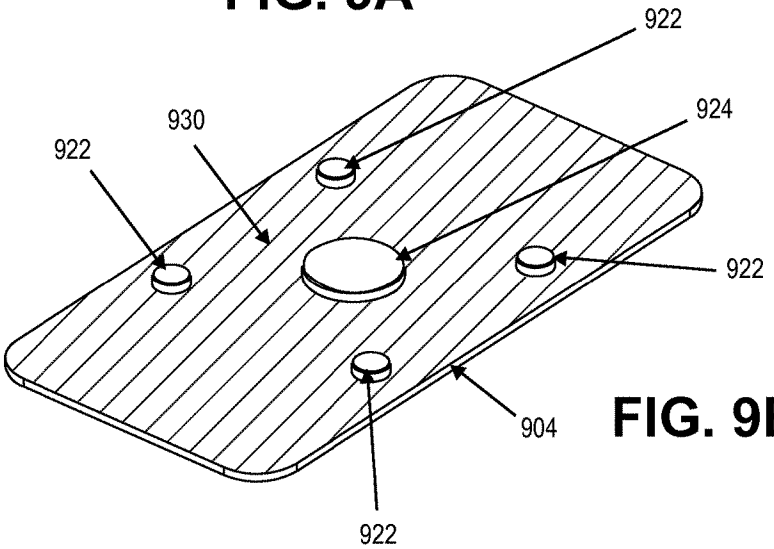

FIGS. 8A and B are schematic views of the button of an alternative embodiment of the invention. This embodiment has only a single beam 802 coupled to an axle 806 which may be rotatably coupled to an axle housing. The button surface 804 may be provided and may be concave, flat, or have other shapes or textures for tactile properties that may be desired. In one embodiment, a magnetic mass. in this case magnet 808, resides in the end of beam 802. Magnet 808 exerts the magnetic field on a magnetic mass 812 which may reside above magnet 808 when installed, such that the attraction biases the button into an up position. As used herein, "magnetic mass" includes magnets and masses comprising ferromagnetic material upon which a magnet may exert an attractive or repulsive force. In one embodiment, a capacitive sensor senses the keypress while the delamination of the magnet 808 from the magnetic mass 812 provides a favorable tactile sensation over the travel responsive to the keypress. It is noted the while the above embodiment is described as having the permanent magnet resident in the beam 802, the magnet 808 and magnetic mass 812 may be reversed without departing from the scope of the invention. In one embodiment a rare earth permanent magnet may be used, such as an N52 NdFeB magnet.

This single beam embodiment is believed to be useful where perfect parallelism is less necessary. For example, this embodiment may be suitable for use with smart phones such as the "home" button on the iPhone (iPhone is a trademark of Apple Inc). Failure in the click dome is a common form of failure in existing iPhone smart phones. Because the magnetic mass and magnet do not experience wear during operation, failure of the home button can be significantly reduced. Additionally, less height is required due to the laterally juxtaposition of elements of the mechanism. thereby enabling creation of a thinner product.

FIGS. 9 A-D show an alternative embodiment of a key in one embodiment of the invention. FIG. 9A show the key cap. FIG. 9B show the key base. FIGS. 9C and D show the key in an Up and a Down state respectively. In such embodiment, a key using magnetic forces without any beams can be realized through an assembly of magnets. The key cap 902 contains four magnets (exemplified by 912) at the inside of each corner, and another magnet 914 in the center. These 5 magnets form pairs with counterparts 922, 924 in the key base 904. The outer four pairs 912, 922 comprise oppositely polarized magnets, which attract the keycap 902 to the key base 904. The center magnet pair 922, 924 has matched polarity providing a repulsive force which causes the key cap to elevate to an Up position. A user overcomes this repulsive force when he presses on the key. The outer attractive magnets 912, 922 register the key cap 902 to the key base 904, and effectively "attach" the key cap 902 and key base 904 via the magnetic field strength. The center magnets 914, 924 effectively provide a spring function to push the key cap 902 up. In this way, a keyswitch can be realized without additional moving parts or wear. Since actuation is guided by magnetic fields without any wiping surfaces, it provides extraordinarily smooth motion and superior feel.

Installation of the key cap 902 is also facilitated by simply bringing the key cap 902 near the key base. No snaps or slots or pegs or axles are needed in this embodiment. A keypress event may be detected with capacitive sensor pads 930 affixed to the key base 904. These sensors 930 can detect a human finger on a keypress event, or they can detect the proximity of the key cap 902 magnets to the key base 904 sensor pads based upon their effect on the capacitance or electric field seen by the plate. Additional metallic elements may be placed in the key cap 902 to interact with the sensor pads 930 to detect a keypress. Hall effect sensors may be alternatively used to detect changes in the magnetic fields as the keypress event occurs. It is also contemplated that a physical contact switch on a membrane panel in the key base 904 could be used, although such metallic contact elements have more limited life than the field-sensing embodiments.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a housing having a first magnetic mass coupled to the housing;

a beam having a button surface disposed on the beam, the beam having an end, the end anchored to the housing; and a second magnetic mass coupled to the beam at a point along the beam different from the anchor;

wherein a magnetic field between the first and second magnetic masses biases the button surface into an up position.

2. The apparatus of claim 1 wherein a magnetic interaction between the first and second magnetic masses is attractive.

3. The apparatus of claim 1 wherein in the up position the first magnetic mass is laminated to the second magnetic mass.

* * * * *